US005602962A

United States Patent [19]

Kellermann

[11] Patent Number: 5,602,962

[45] Date of Patent: Feb. 11, 1997

[54] MOBILE RADIO SET COMPRISING A SPEECH PROCESSING ARRANGEMENT

[75] Inventor: Walter Kellermann, Eckental, Germany

[73] Assignee: U.S. Philips Corporation, New York, N.Y.

[21] Appl. No.: 302,139

[22] Filed: Sep. 7, 1994

[30] Foreign Application Priority Data

Sep. 7, 1993 [DE] Germany ..... 43 30 243.2

[51] Int. Cl.[6] ..... G10L 3/02

[52] U.S. Cl. ..... 395/2.35; 381/92; 381/94

[58] Field of Search ..... 381/46, 47, 71, 381/92, 94; 395/2.35–2.37, 2.42

[56] References Cited

U.S. PATENT DOCUMENTS

| | | | |
|---|---|---|---|
| 4,536,887 | 8/1985 | Kaneda et al. | 381/94 |
| 4,802,227 | 1/1989 | Elko et al. | 381/94 |
| 5,012,519 | 4/1991 | Adlersberg et al. | 381/47 |

OTHER PUBLICATIONS

"Frequency Domain Noise Suppression Approaches in Mobile Telephone Systems", Jin Yang, Published in Proc. ICASSP, vol. 2, pp. 363–366, Apr. 1993.

"Speech Enhancement Using a Soft–Decision Noise Suppression Filter", McAulay et al, IEEE Trans. on ASSP, vol. 28, No. 2, pp. 137–145, Apr. 1980.

R. Zelinski, "A Micro Array With Adaptive Post–Filtering For Noise Reduction In Reverberant Rooms", 1988 International Confernece on Acoustics, Speech, and Signal Processing, Apr. 11–14, 1988, pp. 2578–2581.

*Primary Examiner*—Kee M. Tung

*Attorney, Agent, or Firm*—Eugene J. Rosenthal

[57] ABSTRACT

A speech processing arrangement has at least two microphones for supplying microphone signals formed by speech components and noise components to microphone signal branches that are coupled to an adder device used for forming a sum signal. The microphone signals are delayed and weighted by weight factors in the microphone signal branches. The arrangement includes an evaluation circuit that a) receives the microphone signals, b) estimates the noise components, c) estimates the speech components by forming the difference between one of the microphone signals and the estimated noise component for this microphone signal, d) selects one of the microphone signals as a reference signal which contains a reference noise component and a reference speech component, e) forms speech signal ratios by dividing the estimated speech components by the estimated reference speech component, f) forms noise signal ratios by dividing the powers of the estimated noise components by the power of the estimated reference noise component, and g) determines the weight factors by dividing each speech signal ratio by the associated noise signal ratio. The signal-to-noise ratio corresponds to the ratio of the power of the speech component to the power of the noise component of the sum signal. Because the speech signals are correlated and noise signals are uncorrelated, the sum signal available on the output of the adder device has a reduced noise component yielding improved speech audibility. Real-time computation of the weight factors eliminates any annoying delay during a conversation held using the speech processing arrangement.

7 Claims, 3 Drawing Sheets

MOBILE RADIO SET COMPRISING A SPEECH PROCESSING ARRANGEMENT

TECHNICAL FIELD

The invention relates to a mobile radio set comprising a speech processing arrangement which has at least two microphones used for supplying microphone signals formed by speech components and noise components to microphone signal branches which branches are coupled to the inputs of an adder device used for forming a sum signal.

BACKGROUND OF THE INVENTION

In "Proceedings Internal Conference on Acoustics, Speech, and Signal Processing (ICASSP), pp. 2578–2581, New York, April 1988, IEEE" is discussed a microphone array comprising four microphones positioned in the comers of a room with a square ground plan, whose microphone signals are processed so that the influence of noise signals superimposed on speech signals is reduced. For this purpose, the microphone signals are first mutually shifted with respect to time to cancel delay differences of a speaker with respect to the individual microphones. The microphone signals having thus in-phase speech components are superimposed on a sum signal by an adder device, so that the uncorrelated noise components of the microphone signals are diminished when superimposed. The diminishing is then not optimal if there is an inhomogeneous noise signal area. In that case different noise signal powers occur at the positions where the microphones are installed. The superimposed microphone signals are applied to an adaptive filter (Wiener filter) once they have been diminished by a correction factor used for taking the mean value. This filter is set by evaluating the in-phase microphone signals and provides a further suppression of the noise signals.

SUMMARY OF THE INVENTION

It is an object of the invention to improve the suppression of the noise component of the sum signal available on the output of the adder arrangement.

The object is achieved in that delay means for delaying the microphone signals are included in the microphone signal branches as are weighting means for weighting the microphone signals with weight factors, and in that an evaluation circuit is provided for receiving the microphone signals, for estimating the noise components, for estimating the speech components by forming the difference between one of the microphone signals and the estimated noise component for this microphone signal, for selecting one of the microphone signals as a reference signal which contains a reference noise component and a reference speech component, for forming speech signal ratios by dividing the estimated speech components by the estimated reference speech component, for forming noise signal ratios by dividing the powers of the estimated noise components by the power of the estimated reference noise component, and for determining the weight factors by dividing each speech signal ratio by the associated noise signal ratio.

The signal-to-noise ratio corresponds to the ratio of the power of the speech component to the power of the noise component of the sum signal. The effect of an inhomogeneity of the noise signal area is minimized. Microphone signals containing minor noise components are amplified relative to the microphone signals containing large noise components. Based on the fact that speech signals are correlated and noise signals are uncorrelated, this leads to the fact that the sum signal available on the output of the adder device has a reduced noise component or an increased signal-to-noise ratio respectively, so that an improved speech audibility of the sum signal is achieved.

The cost-effective computation of the weight factors leads to an increased signal-to-noise ratio and an improved speech audibility. Due to the efficient computation of the weight factors it is possible to perform the necessary computations in real-time which is often, so that there is no annoying delay during a conversation held via the speech processing arrangement.

In a further embodiment of the invention, the weight factors are adapted to time-dependent changes of the noise components.

With non-stationary, i.e., time-dependent, noise signal statistics and with constant weight factors, noise suppression deteriorates when the signal statistic changes. An adaptation of the weight factors avoids this. The weight factors are maintained constant in periods of time in which a satisfactory steadiness of the signal statistics of the noise signals is assumed. The length of these periods of time depends on the nature of the noise signal area.

A further embodiment of the invention is characterized in that each microphone signal branch comprises a transforming arrangement for transforming the spectrum of the assigned microphone signal, in that the evaluation circuit is arranged for forming weight factors for each section of the range of the spectrum of the microphone signals and in that each microphone signal branch comprises a weighting means for weighting the spectrum range sections, and comprises an inverse transforming arrangement in this order.

The noise components of the microphone signals do not generally have spectra with equally large spectrum values. For this reason it is useful determining the weight factors of the microphone signals and effecting the weighting not with respect to time, but with respect to the spectrum range, for which purpose a transformation of the microphone signals is necessary, for example, with a Fourier transform. The spectrum range is subdivided into sections having at least one spectrum value. For each section of the spectrum range the optimum weight factors are determined with which the spectrum values of the microphone signals are weighted. An improved reduction of the noise components of the microphone signals is achieved and the audibility of speech is further improved.

BRIEF DESCRIPTION OF THE DRAWINGS

Embodiments of the invention will be further explained below with reference to the drawings in which.

DETAILED DESCRIPTION

Figure 1:
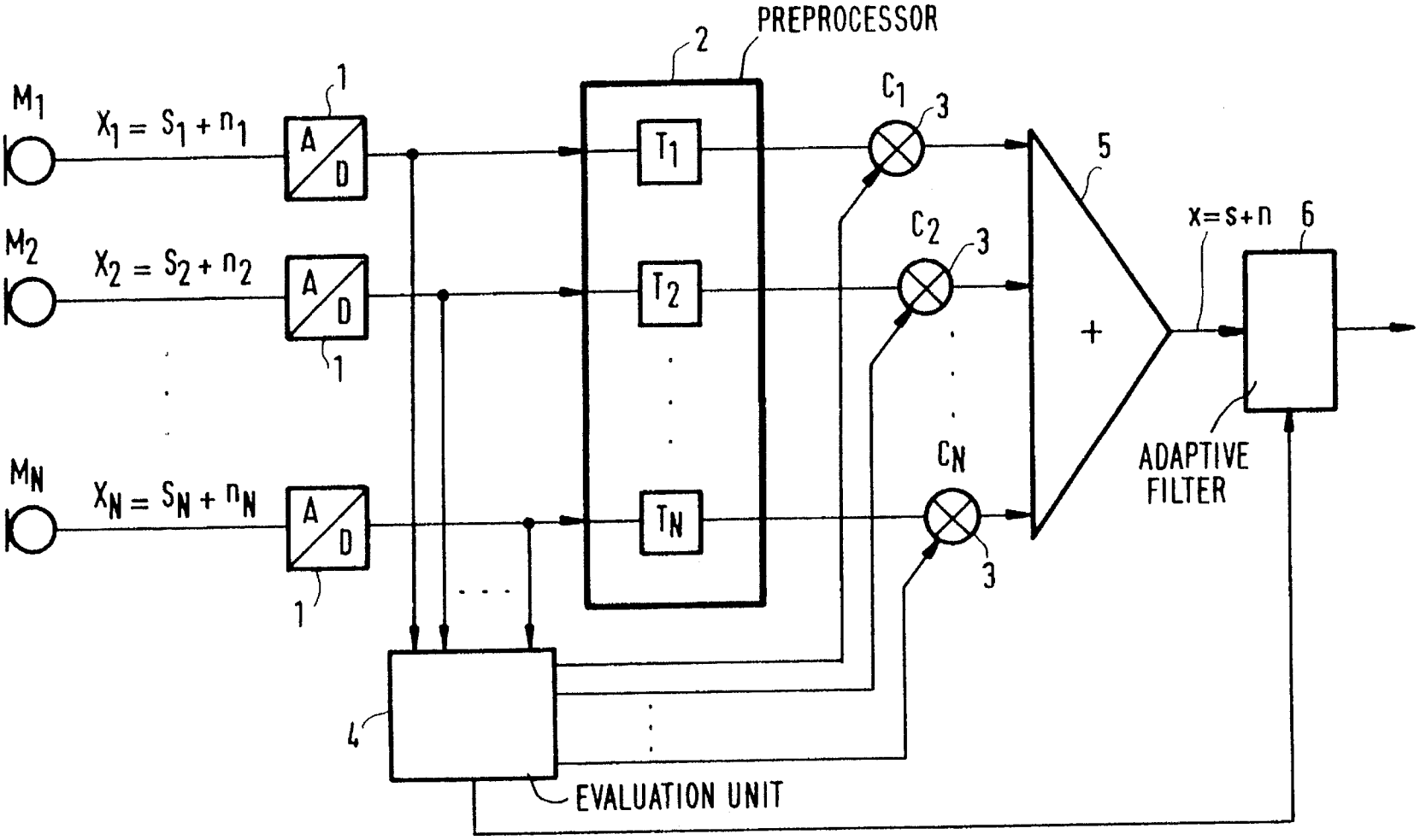
FIG. 1 shows a speech processing arrangement comprising an arrangement for reducing noise signals.

The speech processing arrangement shown in FIG. 1 which is integrated, for example, in hands-free facilities of automotive vehicles, comprises N microphones $M_i(i=1, \ldots, N)$. They convert acoustic signals consisting of speech components and noise components to electric microphone signals $x_i=s_i+n_i(i=1, \ldots, N)$ which are digitized by analog-digital converters 1 for further processing. $x_i$ stands for the microphone signal produced by microphone $M_i$, $s_i$ for the speech component contained therein and $n_i$ for the noise component in the $i^{th}$ microphone signal branch. Like references will apply to the digitized and analog signals in the following. The noise signals are normally noise signals produced by, for example, the engine or head wind noise when the speech processing arrangement is used in motor cars.

The outputs of the analog-to-digital counters 1 are connected to N inputs of a preprocessor unit 2. The latter has for each microphone signal branch a delay element $T_1, \ldots, T_N$, so that delay differences of speech signals of a speech signal source to the microphones $M_1, \ldots, M_N$ are cancelled. The delay elements $T_1, \ldots, T_N$ are adaptively adjusted to the delay differences.

The outputs of the preprocessor unit 2 are connected to controllable multipliers 3 which provide a weighting with weight factors $c_i(i=1, \ldots, N)$ in the microphone signal branches. The weight factors $c_1, \ldots, c_N$ are set by an evaluation unit 4 which determines them by evaluating the microphone signals $x_1, \ldots, x_N$ according to a scheme still to be explained. If an approximately time-dependent steadiness of the statistical properties of the noise components $n_i$ may be assumed, a single computation of the weight factors will suffice.

The outputs of the multipliers 3, which at the same time represent the outputs of the microphone signal branches, are connected to N inputs of an adder device 5. This device produces a sum signal x=s+n from the output signals of the multipliers 3, which sum signal is applied to an adaptive filter 6—for example, a FIR filter arranged as a Wiener filter. The filter 6 is set by the evaluation unit 4 in response to an evaluation of the microphone signals, for example, as in the state of the art cited after the opening paragraph.

In the following the scheme will be explained according to which the evaluation unit 4 determines the weight factors $c_i$. Sample values of the microphone signals $x_i$ are written in the buffer memory arranged in the evaluation unit 4. Estimates for the amplitudes of the noise components $n_i$ are obtained by evaluating the sample values of microphone signals $x_i$ stored in the buffer memory from the periods of time in which no or negligibly small speech components $s_i$ occur. Such speech pauses can be detected by the striking signal shape or spectrum, respectively, of speech signals as against noise signals. By subtracting the determined estimates of the amplitudes of the noise signals $n_i$ from estimates of the amplitudes of microphone signals $x_i$ (with speech components $s_i$) lying outside the speech pauses, which estimates are also determined from sample values stored in the buffer memory, the estimates of the amplitudes of the speech components $s_i$ are determined.

The weight factors $c_1, \ldots, c_N$ are to be dimensioned such that the so-termed signal-to-noise ratio (SNR) of the sum signal x on the output of the adder device 5 is maximized. The SNR appears from the ratio of the power (variance) of the speech component to the power (variance) of the noise component of the sum signal x.

$$SNR = \frac{\sigma_s^2}{\sigma_n^2}$$

$\sigma_s$ and $\sigma_n$ are the standard deviations of the speech component s and of the noise component n of the sum signal x. Furthermore, since $$s_i=a_i s_1,\ i=1, \ldots, N,$$

speech signal ratios $a_i$ are determined by the ratio of the estimated amplitudes of the speech components $s_i$ to the estimated amplitude of the speech component $s_1$ used as a reference speech component, if $x_1$ is used as a reference microphone signal. $n_i$ is then used as a reference noise signal. Reference variables are without constraint as are all the other microphone signals or speech and noise components respectively, that have an index $i \neq 1$. Assuming that the noise components $n_i$ are uncorrelated and free from a mean value, the following holds $$E\{n_i n_j\}=0 \text{ for all } i \neq j$$

and $$E\{n_i^2\}=\sigma_{ni}^2=b_i^2\sigma_{n1}^2$$

where E{ } is used as an expected value operator and $\sigma_{n1}^2$ is used as a reference noise power. This defines noise signal ratios $b_i^2$ by the ratio of the estimated powers $\sigma_{ni}^2$ of the noise components to the estimated power $\sigma_{n1}^2$ of the reference noise component.

Furthermore, there is assumed that the speech and noise components are not mutually correlated and are mean value-free which is described by the expression $$E\{s_i n_j\}=0 \text{ for all } i, j.$$

As a result, the following formula arises for the SNR of the sum signal x:

$$SNR = \frac{E\left\{\left(\sum_{i=1}^{N} c_i s_i\right)^2\right\}}{E\left\{\left(\sum_{i=1}^{N} c_i n_i\right)^2\right\}} = \frac{\sigma_{s1}^2}{\sigma_{n1}^2} \frac{\left(\sum_{i=1}^{N} c_i a_i\right)^2}{\sum_{i=1}^{N} c_i^2 b_i^2}$$

The maximization of this expression with respect to the weight factors $c_i$ yields:

$$c_i=a_i/b_i^2$$

This result is obtained, for example, for the formation of the partial derivatives of above expression for the SNR. A very simple formula for computing the weight factors $c_i$ is obtained.

Figure 2:
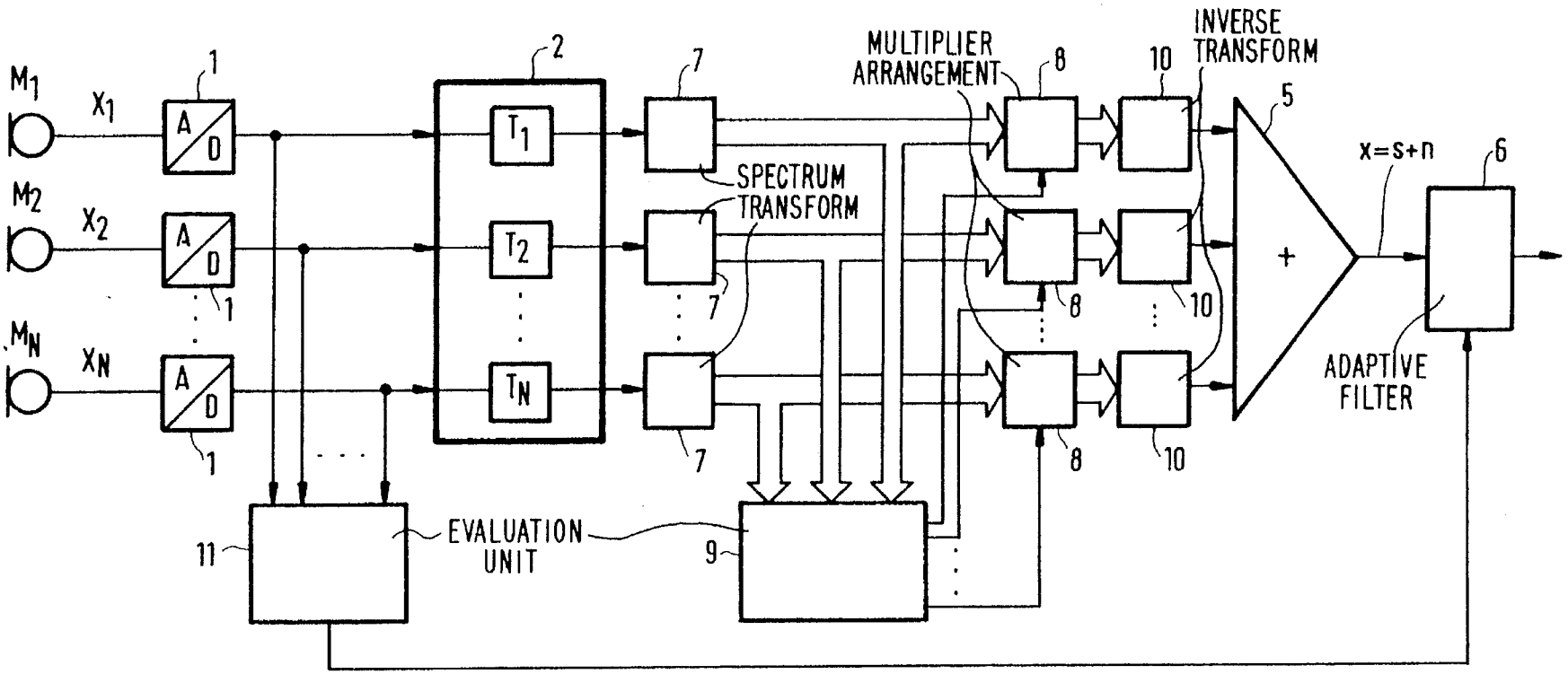
FIG. 2 shows an embodiment of the speech processing arrangement via a processing in the spectrum range.
Figure 3:
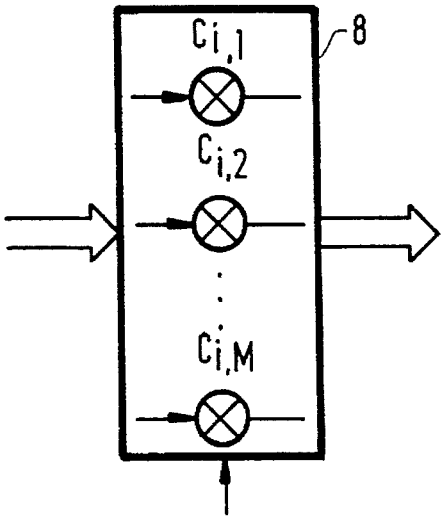
FIG. 3 shows a circuit element of the speech processing arrangement shown in FIG. 2.

The speech processing arrangement described by the FIGS. 2 and 3 represents an embodiment of the speech processing arrangement shown in FIG. 1. As shown in FIG. 2, the N output signals of the preprocessor unit 2, which represent the sample values of the microphone signals $x_1, \ldots, x_N$, are transformed to the spectrum range by spectrum transforming arrangements 7, for example, by a fast Fourier transform (FFT). The spectrum range is subdivided into M sections which contain at least one spectrum value. The spectrum values are applied to N multiplier arrangements 8, which weight each spectrum range section with its own weight factor $c_{i,j}$ separately computed for each spectrum range section. Note that i is the index of the microphone signal branch while j represents the spectrum, or frequency index, respectively, of each spectrum range section.

FIG. 3 shows a basic structure of one of the multiplier arrangements 8, which multiplies the spectrum range sections of the microphone signal branch by the weight factors $c_{i,j}$. The spectrum range contains M spectrum range sections, so that M multipliers are necessary for each microphone signal branch. The weight factors $c_{i,j}$ are set by an evaluation unit 9. They are determined by a maximization of the signal-to-noise ratio (SNR) in the individual spectrum range sections, which is analogous to the computation of the weight factors $c_i$ in the description with reference to FIG. 1. The estimates of the amplitudes of the speech and noise components $s_i$, $n_i$ in the time domain can be replaced by appropriate estimates in the frequency domain. The spectrum values thus weighted are applied to inverse transforming arrangements 10, which inversely transform the weighted spectra of the microphone signal branches to the time domain. The signals thus obtained are added together by the adder device 5 as in FIG. 1, and applied to the adaptive filter 6. This filter is set by an evaluation unit 11 which evaluates, just like the evaluation unit 4 in FIG. 1, the microphone signals $x_i$ available on the outputs of the analog-to-digital converter 1.

The signal-to-noise ratio (SNR) of the sum signal x can be further increased and the speech audibility improved by a speech processor unit thus arranged, because them is taken into account that the power of the noise components in the range of the spectrum is not uniformly distributed over all the spectrum values.

For the case of a time-variant noise signal statistic, i.e., where the standard deviations $\sigma_{ni}$ are not approximately time-independent, the weight factors $c_i$ and $c_{i,j}$ respectively, are constantly recomputed and reset. This depends on the nature of each noise signal area. For example, the noise signal statistic of a vehicle is changed considerably when the vehicle accelerates from a stationary position, because noise arises, for example, due to head wind.

Figure 4:
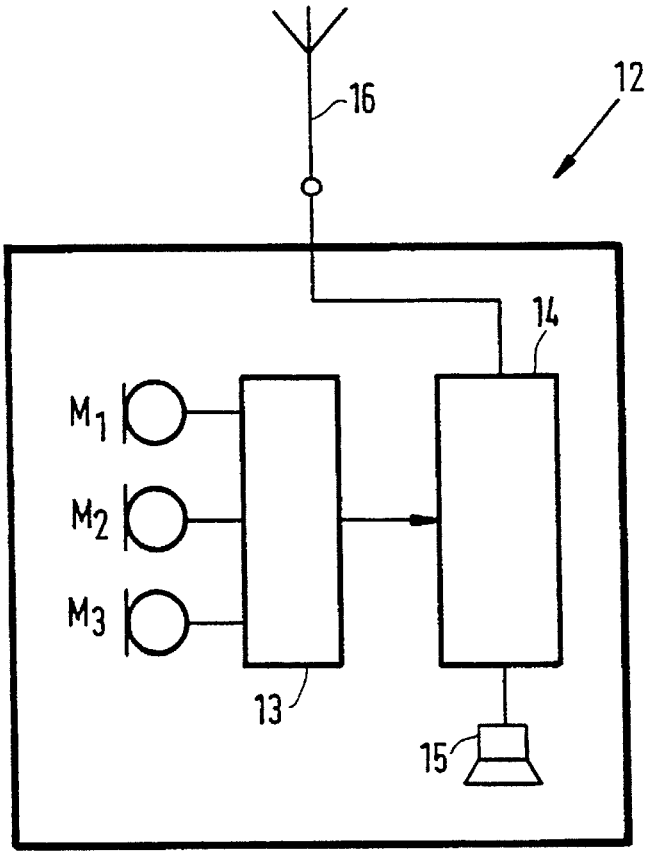
FIG. 4 shows a mobile radio set in which the speech processing arrangement is integrated.

In FIG. 4 is shown a mobile radio set 12 in which the speech processor unit 13 is integrated which is supplied with microphone signals via an array of three microphones $M_1$, $M_2$ and $M_3$. The structure of the speech processor unit 13 can be learnt from either FIG. 1 or FIGS. 2 and 3 with the associated descriptions. Output signals of the speech processor unit 13 are applied to a functional block 14 which combines the further functional units of the mobile radio set 12 and to which are coupled a loudspeaker 15 and an aerial 16. The microphones $M_1$, $M_2$ and $M_3$, the speech processor unit 13 and the loudspeaker 15, together with the functional block 14, operate as parts of a hands-free facility of the mobile radio set 12.

I claim:

1. A radio set comprising a speech processing arrangement having at least two microphones ($M_1, \ldots, M_N$) for supplying microphone signals ($x_1, \ldots, x_N$) formed by speech components and noise components ($s_1, \ldots, S_N, n_1, \ldots, n_N$) to microphone signal branches that are coupled to inputs of an adder device used for forming which forms a sum signal (x), wherein delay means ($T_1, \ldots, T_N$) for delaying the microphone signals ($x_1, \ldots, x_N$) and weighting means for weighting the microphone signals ($x_1, \ldots, x_N$) with weight factors ($c_1, \ldots, c_N$) are included in the microphone signal branches, and an evaluation circuit, said evaluation circuit including:

means for receiving a representation of the microphone signals ($x_1, \ldots, x_N$), means for estimating the noise components ($n_1 \ldots, n_N$), means for estimating the speech components ($s_1, \ldots, s_N$) by forming the difference between a representation of one of the microphone signals ($x_i$) and the estimated noise component ($n_i$) for this microphone signal ($x_i$), means for selecting one of the microphone signals ($x_i$) as a reference signal ($x_i$) which contains a reference noise component ($n_i$) and a reference speech component ($s_1$), means for forming speech signal ratios ($a_i, \ldots, a_N$) by dividing the estimated speech components ($s_1, \ldots, s_N$) by the estimated reference speech component ($s_1$), means for forming noise signal ratios ($b_1^2, \ldots, b_N^2$) by dividing powers ($\sigma_{n1}^2, \ldots, \sigma_{nN}^2$) of the estimated noise components ($n_1, \ldots, n_N$) by a power ($\sigma_{n1}^2$) of the estimated reference noise component ($n_1$), and means for determining the weight factors ($c_1, \ldots, C_N$) by dividing each speech signal ratio ($a_1, \ldots, a_N$) by the associated noise signal ratio ($b_i^2$).

2. The mobile radio set as claimed in claim 1, wherein in that the speech processing arrangement is integrated in a hands-free facility.

3. The mobile radio set as claimed in claim 1, wherein the weight factors ($c_1, \ldots, c_N$) are adapted to time-dependent changes of the noise components ($n_1, \ldots, n_N$).

4. The mobile radio set as claimed in claim 1, wherein each microphone signal has a spectrum and each microphone signal branch comprises a transforming arrangement for transforming the spectrum of its microphone signal ($x_i$), in that the evaluation circuit is arranged for forming weight factors ($c_{i,j}$) for each section of the range of the spectrum of the microphone signals ($x_1, \ldots, x_N$) and in that each microphone signal branch comprises a weighting means for weighting the spectrum range sections, and comprises an inverse transforming arrangement in this order.

5. A speech processing arrangement comprising at least two microphones ($M_1, \ldots, M_N$) used for supplying microphone signals ($x_1, \ldots, x_N$) formed by speech components and noise components ($s_1, \ldots, s_N, n_1, \ldots, n_N$) to microphone signal branches which branches are coupled to inputs of an adder device used for forming a sum signal (x), wherein delay means ($T_1, \ldots, T_N$) for delaying the microphone signals ($x_1, x_N$) and weighting means for weighting the microphone signals ($x_1, \ldots, x_N$) with weight factors ($c_1, \ldots, c_N$) are included in the microphone signal branches, and an evaluation circuit is provided means for receiving the microphone signals ($x_1, \ldots, x_N$), means for estimating the noise components ($n_1, \ldots, n_N$), means for estimating the speech components ($s_1, \ldots, s_N$) by forming the difference between one of the microphone signals ($x_i$) and the estimated noise component ($n_i$) for this microphone signal ($x_i$), means for selecting one of the microphone signals ($x_i$) as a reference signal which contains a reference noise component ($n_1$) and a reference speech component ($s_1$), means for forming speech signal ratios ($a_1, \ldots, a_N$) by dividing the estimated speech components ($s_1, \ldots, s_N$) by the estimated reference speech component ($s_1$), means for forming noise signal ratios ($b_1^2, \ldots, b_N^2$) by dividing the powers ($\sigma_{n1}^2, \ldots, \sigma_{nN}^2$) of estimated noise components ($n_1, \ldots, n_N$) by a power ($\sigma_{n1}^2$) of the estimated reference noise component ($n_1$), and means for determining the weight factors ($c_1, \ldots, c_N$) by dividing each speech signal ratio ($a_1, \ldots, a_N$) by the associated noise signal ratio ($b_i^2$).

6. A method for use in an evaluation circuit which is part of a speech processing arrangement, the speech processing arrangement having at least two microphones which are used for supplying microphone signals formed by speech components and noise components to microphone signal branches which are coupled to inputs of an adder device used for forming a sum signal, wherein delay means for delaying the microphone signals and weighting means for weighting the microphone signals with weight factors are included in the microphone signal branches, the method for use in the evaluation circuit comprising the steps of:

receiving the microphone signals;

estimating the noise components;

estimating the speech components by forming the difference between one of the microphone signals and the estimated noise component for this microphone signal;

selecting one of the microphone signals as a reference signal which contains a reference noise component ($n_1$) and a reference speech component;

forming speech signal ratios by dividing the estimated speech components by the estimated reference speech component;

forming noise signal ratios by dividing the powers of estimated noise components by a power of the estimated reference noise component; and determining the weight factors by dividing each speech signal ratio by the associated noise signal ratio.

7. The invention as defined in claimed in claim 6, wherein (i) each microphone signal has a spectrum, (ii) each microphone signal branch includes a transforming arrangement for transforming the spectrum of its microphone signal and a weighting means for weighting range sections of the spectrum, and (iii) wherein the evaluation circuit develops weight factors for each of the range section of the spectrum of the microphone signals.

* * * * *